US008302527B2

(12) United States Patent
Heitmann et al.

(10) Patent No.: US 8,302,527 B2
(45) Date of Patent: Nov. 6, 2012

(54) METHOD FOR DETERMINING THE VARIATION WITH TIME OF THE AMOUNT OF STEAM RELEASED FROM A FOOD PRODUCT DURING A COOKING PROCESS IN A COOKING CHAMBER OF A BAKING OVEN

(75) Inventors: Sonja Heitmann, Guetersloh (DE); Wenzel Meierfrankenfeld, Guetersloh (DE); Nico Zurmuehlen, Guetersloh (DE)

(73) Assignee: Miele & Cie. KG, Guetersloh (DE)

( * ) Notice: Subject to any disclaimer, the term of this patent is extended or adjusted under 35 U.S.C. 154(b) by 1307 days.

(21) Appl. No.: 11/952,425

(22) Filed: Dec. 7, 2007

(65) Prior Publication Data

US 2008/0134904 A1 Jun. 12, 2008

(30) Foreign Application Priority Data

Dec. 11, 2006 (DE) ..... 10 2006 058 617

(51) Int. Cl.
*A23L 1/01* (2006.01)

(52) U.S. Cl. ..... 99/342; 99/331; 99/468; 219/707

(58) Field of Classification Search ..... 99/330–333, 99/325, 345–347, 451, 468, 473, 476, 470, 99/483; 126/20, 21 A; 219/400, 401; 426/510, 426/523

See application file for complete search history.

(56) References Cited

U.S. PATENT DOCUMENTS

| | | | | |
|---|---|---|---|---|
| 4,734,554 | A | 3/1988 | Tateda et al. | |
| 4,812,624 | A * | 3/1989 | Kern | 219/448.14 |
| 5,078,048 | A * | 1/1992 | Yoshino et al. | 99/331 |
| 5,272,963 | A * | 12/1993 | Del Fabbro | 99/468 |
| 5,323,692 | A * | 6/1994 | Grzywna et al. | 99/343 |
| 5,369,253 | A * | 11/1994 | Kuwata et al. | 219/707 |
| 6,279,464 | B1 * | 8/2001 | Lo et al. | 99/331 |
| 6,753,027 | B1 * | 6/2004 | Greiner et al. | 426/233 |
| 2003/0106892 | A1 * | 6/2003 | Shon et al. | 219/707 |

FOREIGN PATENT DOCUMENTS

DE 3804678 8/1989

(Continued)

*Primary Examiner* — Henry Yuen
*Assistant Examiner* — Thien S Tran
(74) *Attorney, Agent, or Firm* — Leydig, Voit & Mayer, Ltd.

(57) ABSTRACT

A method and device for determining a variation with time of an amount of steam released from a food product during a cooking process in a cooking chamber of a baking oven. A heat sink is provided outside the cooking chamber or a vapor duct in fluid communication with the cooking chamber. A sensing head of a heat conducting body projects into the cooking chamber or vapor duct, and the heat conducting body is operable to transfer heat to the heat sink. The sensing head is protected from precipitation of condensate on its surface by its spatial positioning and/or the mode of operation of the baking oven. A variation with time of the temperatures of the sensing head and cooking chamber are measured with first and second temperature sensors, respectively. The variation with time of the amount of steam in the cooking chamber is determined using an evaluation circuit of a controller as a function of measurement signals generated by the first and second temperature sensors.

18 Claims, 1 Drawing Sheet

FOREIGN PATENT DOCUMENTS

| | | | |
|---|---|---|---|
| DE | 4109565 | | 9/1992 |
| DE | 4341410 | | 6/1995 |
| DE | 4401642 | | 7/1995 |
| EP | 0455169 | | 11/1991 |
| EP | 504555 | | 9/1992 |
| EP | 664097 | | 7/1995 |
| JP | 05-087345 | * | 4/1993 |

* cited by examiner

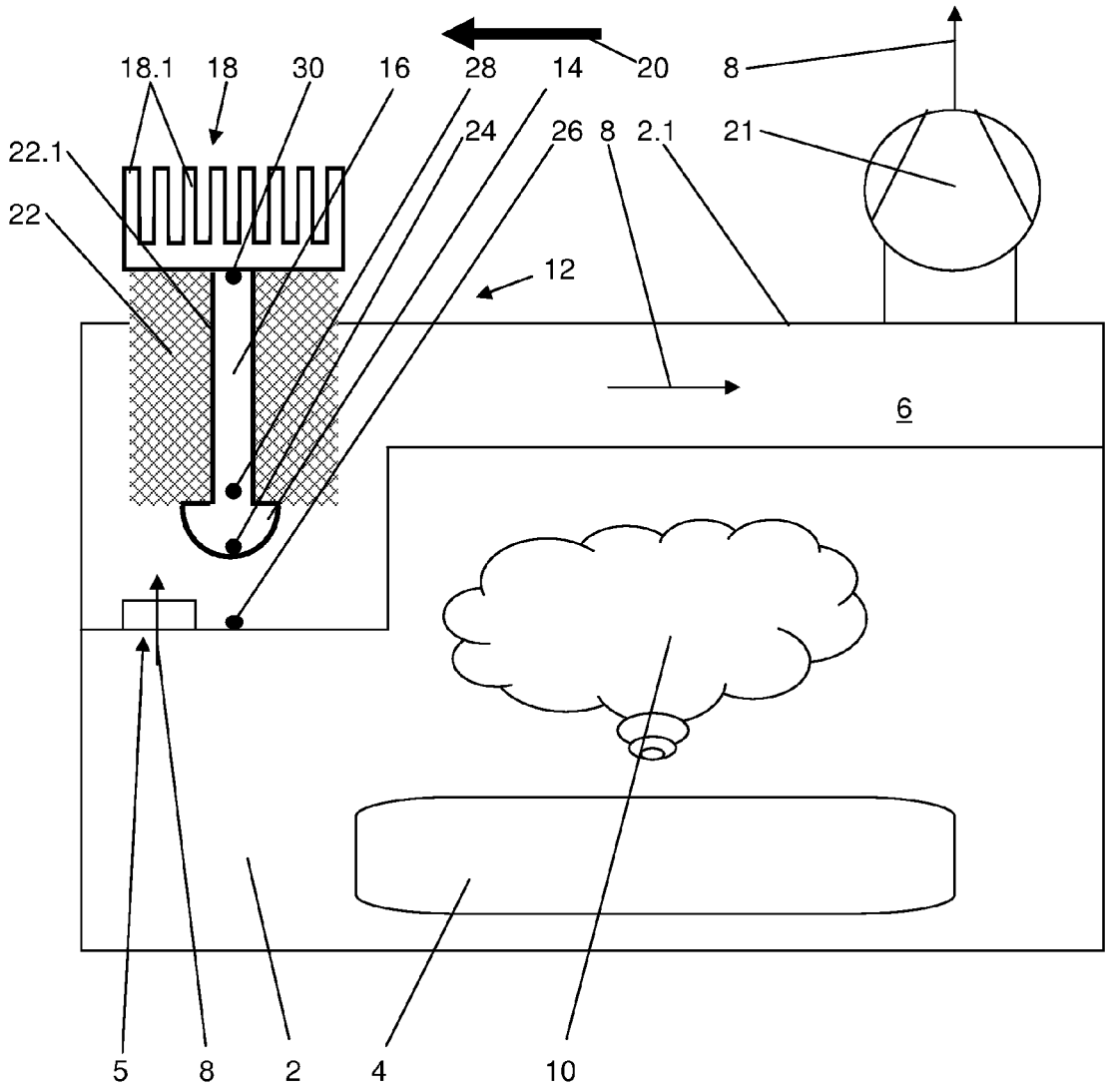
18.1
18
30
16
28
14
20
8
22.1
24
26
8
2.1
21
22
12
6
5
8
2
4
10

METHOD FOR DETERMINING THE VARIATION WITH TIME OF THE AMOUNT OF STEAM RELEASED FROM A FOOD PRODUCT DURING A COOKING PROCESS IN A COOKING CHAMBER OF A BAKING OVEN

CROSS REFERENCE TO RELATED APPLICATIONS

Priority is claimed to German patent application DE 10 2006 058 617.4, filed Dec. 11, 2006, and which is hereby incorporated by reference herein.

FIELD OF THE INVENTION

The present invention relates to a method for determining the variation with time of the amount of steam released from a food product during a cooking process in a cooking chamber of a baking oven.

BACKGROUND

The amount of steam released from a food product in a time interval during a cooking process in a cooking chamber of a baking oven can be determined directly, for example using a humidity sensor as described in U.S. Pat. No. 4,734,554, or indirectly, for example using an oxygen sensor, to allow for humidity-dependent control of the baking oven in order, for example, to automatically determine the end of cooking time. In this connection, it is possible to use any suitable heating source known in the art, except for heating steam, because it is impossible to distinguish between the heating steam and the steam that is released from the food product during cooking. However, the described sensor technology is relatively expensive.

Furthermore, German Patent Publication DE 44 01 642 A1 describes a steam cooking device, where the amount of steam is controlled by the heating of the cooking chamber. For this purpose, the amount of steam present in the cooking chamber is determined using a temperature sensor. The temperature sensor has a sensing part located in a condensation section, and a mounting part which is in contact with the ambient air. Therefore, the temperature occurring at the temperature sensor will be lower than the steam temperature.

Moreover, German Patent Publication DE 41 09 565 A1 describes a method, where the steam content in a cooking chamber is determined using a so-called condensate trap. In the process, the temperature variation at the condensate trap is monitored during condensation and used to automatically determine the level of steam. Thus, this method is designed for use in cooking appliances that use steam as a heating medium. In this method, it is not necessary to distinguish between the heating steam and the steam that is released from the food product during cooking, since the intention here is only to control the supply of heating steam.

SUMMARY

In view of the above, an aspect of the present invention is to provide a method by which the variation with time of the amount of steam released from a food product during a cooking process in a cooking chamber of a baking oven can be automatically determined using inexpensive means.

In an embodiment, the present invention provides a method and device for determining a variation with time of an amount of steam released from a food product during a cooking process in a cooking chamber of a baking oven. A heat sink is provided outside the cooking chamber or a vapor duct in fluid communication with the cooking chamber. A sensing head of a heat conducting body projects into the cooking chamber or vapor duct, and the heat conducting body is operable to transfer heat to the heat sink. The sensing head is protected from precipitation of condensate on its surface by its spatial positioning and/or the mode of operation of the baking oven. A variation with time of the temperatures of the sensing head and cooking chamber are measured with first and second temperature sensors, respectively. The variation with time of the amount of steam in the cooking chamber is determined using an evaluation circuit of a controller as a function of measurement signals generated by the first and second temperature sensors.

BRIEF DESCRIPTION OF THE DRAWINGS

The present invention will be described in the following with respect to an exemplary embodiment and the drawing, in which:

FIG. 1 shows a device according to the present invention for carrying out the inventive method.

DETAILED DESCRIPTION

An aspect of the present invention is that it allows the variation with time of the amount of steam released from a food product during a cooking process in a cooking chamber of a baking oven to be automatically determined using inexpensive means.

In an embodiment of the present invention a third temperature sensor can measure the temperature of the heat sink, and the variation with time of the amount of steam during the cooking process may be determined as a function of the measurement signals provided by the three temperature sensors to the controller. This can improve the accuracy of the method.

In an embodiment, a fourth temperature sensor can measure the temperature inside the heat-conducting body between the sensing head and the heat sink, and the variation with time of the amount of steam during the cooking process is determined as a function of the measurement signals provided by the four temperature sensors to the controller. In this manner, the accuracy of the method is further improved, so that, in addition, the absolute value of the amount of steam released from the food product can be determined at a point during the cooking process.

The variation with time of the amount of steam in the cooking chamber determined in accordance with the present invention can, in principle, be further processed in a manner that is selectable within wide suitable limits. In an embodiment, the level of doneness of a food product being cooked in the cooking chamber is automatically determined as a function of the variation with time of the amount of steam in the cooking chamber.

In an embodiment of the present invention, when the amount of steam increases during an initial phase of a cooking process, after which the amount of steam decreases during a final phase of the cooking process following the initial phase, the end of the cooking process can be automatically determined. In this manner, very useful information about the cooking process is provided to the user in a particularly simple way.

Another aspect of the present invention is to provide a device for carrying out the above-described method.

In an embodiment, the present invention provides a device for determining a variation with time of an amount of steam released from a food product during a cooking process in a cooking chamber of a baking oven, a vapor duct in fluid communication with the cooking chamber. The device includes a heat sink, a heat conducting body and first and second temperature sensors. The heat sink is disposed outside the cooking chamber and the vapor duct. The heat-conducting body is operable to transfer heat from the cooking chamber or vapor duct to the heat sink. The heat-conducting body includes a sensing head projecting into the cooking chamber or the vapor duct. The sensing head is heat-conductively connected to the heat sink by a connecting part that is set back relative to the sensing head in a direction transverse to a direction of extension of the heat conducting body. The first temperature sensor disposed on the sensing head and the second temperature sensor disposed in the cooking chamber or vapor duct.

A particularly compact construction of the device is made possible if the heat-conducting body of the inventive device has a sensing head which is heat-conductively connected to the heat sink by a connecting part which is set back relative to the sensing head in a direction transverse to the main direction of extension of the heat-conducting body, as in one embodiment.

In an embodiment, the heat-conducting body is formed as a massive aluminum body. In this manner, very good heat conduction is obtained, which allows the heat-conducting body to be constructed in an even more compact manner.

In another embodiment, the heat-conducting body and the heat sink are formed as a single massive body. This reduces the complexity of the design.

In a further embodiment, the heat-conducting body is thermally isolated from the body of the baking oven by an insulation, the insulation being provided on the connecting part in the region between the sensing head and the heat sink. In this manner, a particularly simple and inexpensive thermal insulation is achieved.

FIG. 1 is a schematic view of a device according to the present invention. This device is a baking oven having a cooking chamber 2 which is closable by a door and in which a food product 4 is being prepared. Cooking vapors which are produced during the cooking process are discharged to the ambient environment through a vapor duct 6 connected in fluid communication with cooking chamber 2 via an opening 5, as symbolized by arrows 8. Such cooking vapors are composed of air and of steam (symbolized by a cloud 10) which escapes from food product 4 during the cooking process.

A heat-conducting body 12 having a sensing head 14 projects into vapor duct 6 from outside. Heat-conducting body 12 is heat-conductively connected to a heat sink 18 by a connecting part 16 which is set back relative to sensing head 14. In the present exemplary embodiment, sensing head 14 and connecting part 16 of heat-conducting body 12, and heat sink 18, are together formed as a single massive body. For better heat conduction, the aforementioned body, i.e., heat-conducting body 12 and heat sink 18, is formed from aluminum. However, it is, in principle, also possible to use other suitable materials known to those skilled in the art. For better cooling, heat sink 18 may be disposed in the cooling-air flow produced by a fan and, in addition, is provided with cooling fins 18.1. The cooling-air flow is symbolized by an arrow 20. In principle, the heat sink could also be cooled by free convection instead of forced flow.

In the present embodiment, in order to prevent steam contained in the cooking vapors from condensing on sensing head 14, it is sufficient that heat-conducting body 12 be located in vapor duct 6. Due to the flow conditions prevailing in vapor duct 6 during the cooking process, and because of the further operating conditions during normal operation of the baking oven, such as the normal cooking temperatures, the cooling capacity of heat sink 18, and because no heating steam is used for heating the cooking chamber 2, condensation is reliably prevented from occurring on sensing head 14 during the cooking process. The exhaust air flow is produced, for example, by an exhaust fan 21. Here, the design and mode of operation of exhaust fan 21 are matched to the particular baking oven in such a manner that the flow conditions in vapor duct 6 are substantially constant. It preferable for the method of the invention, and for the device for carrying out the method, that minimal or no condensation occur on the sensing head.

Besides the aforementioned option, sensing head 14 could also be placed directly in cooking chamber 2, provided that the above condition is satisfied, namely the reliable prevention of condensation on sensing head 14 in all possible operating conditions of the baking oven during a cooking process.

A thermal insulation 22 is provided to prevent unwanted heat transfer from heat-conducting body 12 to cooking chamber wall 2.1, and thus to the body of the baking oven. Since connecting part 16 is set back relative to sensing head 14 and relative to heat sink 18, insulation 22 can be held on heat-conducting body 12 in a particularly simple manner. For example, insulation 22 may have a through-hole 22.1 whose shape corresponds to that of connecting part 16, and may further be slit on one side, so that insulation 22 can be slipped onto heat-conducting body 12 via the slit without requiring any additional tools or fasteners.

Moreover, the unit formed by heat-conducting body 12 and heat sink 18 can be secured by heat sink 18 to the body of the baking oven via conventional fastening elements. Thus, heat transfer from heat-conducting body 12 to cooking chamber wall 2.1, and thus to the body of the baking oven, is further reduced.

A first temperature sensor 24 is disposed on sensing head 14 for measuring the temperature at sensing head 14, and a second temperature sensor 26 is disposed on vapor duct 6 for measuring the temperature of the cooking chamber atmosphere. In the present case, second temperature sensor 26 is located on the wall of vapor duct 6 that is opposite sensing head 14. In this context, the two temperature sensors 24 and 26, and thus sensing head 14 and second temperature sensor 26, may be disposed in as close a proximity to each other as possible to preclude interference effects caused, for example, by progressive cooling of the cooking vapors as they pass through vapor duct 6. The electrically conductive connection of the two temperature sensors 24, 26 to a controller of the baking oven is not specifically shown. The electrical leads of first temperature sensor 24 could, for example, be passed through insulation 22.

The method according to the present invention will now be described in more detail with reference to the FIGURE.

The method according to the present invention is based on the heat transfer from sensing head 14 to heat sink 18 via connecting part 16. This requires that the temperature in cooking chamber 2, and thus in vapor duct 6, be higher than the temperature of heat sink 18.

The heat of the cooking vapors enters heat-conducting body 12 via sensing head 14. Since the rate of heat input from the cooking vapors into heat-conducting body 12 depends on the surface area of sensing head 14, sensing head 14 may be enlarged with respect to connecting part 16. Based on insulation 22, the following equations may be derived for the heat transfer through heat-conducting body 12:

$$Q_{cooking\ vapors/sensing\ head}=Q_{connecting\ part} \quad (1)$$

$$\alpha_{cooking\ vapors}\times A_{sensing\ head}\times(T_{cooking\ vapors}-T_{sensing\ head})=\lambda\times(1/L)\times A_{connecting\ part}\times(T_1-T_2) \quad (2)$$

where Q=heat flow, $\alpha_{cooking\ vapors}$=heat transfer coefficient, A=the particular surface area of heat transfer, L=length, λ=thermal conductivity of connecting part 16, and T=the particular temperature, with $T_1$ being the temperature of connecting part 16 at the end facing sensing head 14, and $T_2$ being the temperature of connecting part 16 at the end facing heat sink 18.

The purpose of the method according to the present invention is not to determine the absolute value of the amount of steam escaping from the food product during a cooking process, but only to determine the variation with time of the amount of steam escaping from a food product in a time interval during a cooking process. Therefore, for the purpose of the present invention, it is sufficient to determine the temperature difference ($T_{cooking\ vapors}-T_{sensing\ head}$) between first and second temperature sensors 24 and 26. Based on this temperature difference ($T_{cooking\ vapors}-T_{sensing\ head}$), the controller of the baking oven can derive $\alpha_{cooking\ vapors}$, and thus the variation with time of the amount of steam released from food product 4 during the cooking process, according to equation (2), since $\alpha_{cooking\ vapors}$ depends on the amount of steam contained in the cooking vapors.

Accordingly, temperature measurements are made continuously or at predetermined intervals throughout the cooking process, first temperature sensor 24 measuring the temperature at sensing head 14 of heat-conducting body 12, and second temperature sensor 26 measuring the temperature of the cooking chamber atmosphere. The temperature difference ($T_{cooking\ vapors}-T_{sensing\ head}$) is calculated from the measured values by the evaluation circuit of the controller, as described earlier above. The amount of steam released from food product 4 can then be deduced from said temperature difference. Thus, the variation with time of the amount of steam released from food product 4 in cooking chamber 2 during the cooking process is obtained from the values measured in the course of the cooking process, i.e., the variations with time of the measured temperatures, and from the temperature differences calculated therefrom, i.e., the variation with time of the temperature difference.

Since it is not important here to determine the absolute amount of steam, but only to determine the variation with time of the amount of steam released from food product 4 during a cooking process, the above-described insulation 22 could, in principle, be dispensed with.

As explained earlier, the additional measurement of the temperature at the end of connecting part 16 facing sensing head 14 by a third temperature sensor 28 and the measurement of the temperature at the end of connecting part 16 facing heat sink 18 by a fourth temperature sensor 30 may improve the accuracy of the method. In addition, this also allows the absolute value of the amount of steam released from food product 4 to be automatically determined by the controller.

In the present exemplary embodiment, the level of doneness of food product 4 is automatically determined as a function of the temperatures measured by first and second temperature sensors 24, 26. More specifically, the point at which the cooking process will be completed is thereby extrapolated. The end of cooking time estimated in this way is displayed on a display of the oven, and is updated continuously or at predetermined intervals. To this end, the aforementioned temperature measurements are used to monitor whether, after an initial phase of the cooking process during which the amount of steam has increased, the amount of steam decreases during a final phase of the cooking process following the initial phase.

The present invention is not limited to the exemplary embodiment described herein. In particular, the device of the present invention may be made from other suitable materials known to those skilled in the art. Other structural configurations are also possible for the device. Instead of using the variation with time of the amount of steam released from the food product during a cooking process, which is determined in the manner described above, to automatically determine the end of cooking time, other known uses are also possible.

What is claimed is:

1. A method for determining a variation with time of an amount of steam released from a food product during a cooking process in a cooking chamber of a baking oven, the method comprising:

providing a baking oven including a cooking chamber, a vapor duct in fluid communication with the cooking chamber, and a heat sink outside the cooking chamber and the vapor duct;

providing a sensing head of a heat conducting body, the sensing head projecting into the cooking chamber or the vapor duct, the heat conducting body being operable to transfer heat to the heat sink, the sensing head being protected from precipitation of condensate on a surface thereof during all operating conditions of the cooking process by at least one of a spatial position of the sensing head and a mode of operation of the baking oven;

measuring a variation with time of a temperature of the sensing head using a first temperature sensor;

measuring a variation with time of a temperature of the cooking chamber with a second temperature sensor; and determining the variation with time of the amount of steam using an evaluation circuit of a controller as a function of measurement signals generated by the first and second temperature sensors.

2. The method as recited in claim 1 further comprising:

measuring a temperature of the heat sink using a third temperature sensor: and receiving, by the controller, the measurement signal generated by the first and second temperature sensors and a measurement signal generated by the third temperature sensor, wherein the determining the variation with time of the amount of steam is performed as a function of the measurement signals generated by the first, second and third temperature sensors.

3. The method as recited in claim 2, further comprising:

measuring a temperature inside the heat-conducting body between the sensing head and the heat sink using a fourth temperature sensor; and receiving by the controller a measurement signal generated by the fourth temperature sensor, wherein the determining the variation with time of the amount of steam is performed as a function of the measurement signals generated by the first, second, third and fourth temperature sensors.

4. The method as recited in claim 1 further comprising automatically determining a level of doneness of a food product being cooked in the cooking chamber as a function of the variation with time of the amount of steam in the cooking chamber.

5. The method as recited in claim 2 further comprising automatically determining a level of doneness of a food product being cooked in the cooking chamber as a function of the variation with time of the amount of steam in the cooking chamber.

6. The method as recited in claim 3 further comprising automatically determining a level of doneness of a food product being cooked in the cooking chamber as a function of the variation with time of the amount of steam in the cooking chamber.

7. The method as recited in claim 4 further comprising automatically determining an end of a cooking process when the amount of steam increases during an initial phase of a cooking process and then decreases during a final phase of the cooking process.

8. The method as recited in claim 5 further comprising automatically determining an end of a cooking process when the amount of steam increases during an initial phase of a cooking process and then decreases during a final phase of the cooking process.

9. The method as recited in claim 6 further comprising automatically determining an end of a cooking process when the amount of steam increases during an initial phase of a cooking process and then decreases during a final phase of the cooking process.

10. A device for determining a variation with time of an amount of steam released from a food product during a cooking process in a cooking chamber of a baking oven, the device comprising:

a cooking chamber;

a vapor duct in fluid communication with the cooking chamber:

a heat sink disposed outside the cooking chamber and the vapor duct;

a heat-conducting body operable to transfer heat from the cooking chamber or vapor duct to the heat sink, the heat-conducting body including a sensing head projecting into the cooking chamber or vapor duct, the sensing head being heat-conductively connected to the heat sink by a connecting part that is set back relative to the sensing head in a direction transverse to a direction of extension of the heat conducting body;

a first temperature sensor disposed on the sensing head;

a second temperature sensor disposed in the cooking chamber or vapor duct; and a controller including an evaluation circuit configured to determine the variation with time of the amount of steam released from the food product during the cooking process based on a heat flow rate through a surface of the sensing head and through the connecting part.

11. The device as recited in claim 10 wherein the heat-conducting body comprises aluminum.

12. The device as recited in claim 10 wherein the heat-conducting body includes a aluminum body.

13. The device as recited in claim 10 wherein the heat-conducting body and the heat sink comprise a single body.

14. The device as recited in claim 10 wherein the heat-conducting body is thermally isolated from a body of the baking oven by an insulation provided on the connecting part between the sensing head and the heat sink.

15. The device as recited in claim 12 wherein the heat-conducting body is thermally isolated from a body of the baking oven by an insulation provided on the connecting part between the sensing head and the heat sink.

16. The device as recited in claim 13 wherein the heat-conducting body is thermally isolated from a body of the baking oven by an insulation provided on the connecting part between the sensing head and the heat sink.

17. The device as recited in claim 10 further comprising a third temperature sensor operable to measure a temperature of the heat sink.

18. The device as recited in claim 17 further comprising a fourth temperature sensor operable to measure a temperature inside the heat-conducting body between the sensing head and the heat sink.

* * * * *